United States Patent [19]

Karp

[11] 4,219,758

[45] Aug. 26, 1980

[54] TRAVELING WAVE TUBE WITH NON-RECIPROCAL ATTENUATING ADJUNCT

[75] Inventor: Arthur Karp, Palo Alto, Calif.

[73] Assignee: Varian Associates, Inc., Palo Alto, Calif.

[21] Appl. No.: 965,452

[22] Filed: Nov. 30, 1978

[51] Int. Cl.[2] ..... H01J 25/34

[52] U.S. Cl. ..... 315/3.6; 315/3.5; 330/43; 333/120

[58] Field of Search ..... 330/43; 315/3.6, 3.5; 333/1.1, 109, 110, 111, 120

[56] References Cited

U.S. PATENT DOCUMENTS

| | | | |
|---|---|---|---|
| 2,815,466 | 12/1957 | Sensiper | 315/3.6 |
| 2,849,642 | 8/1958 | Goodall | 315/3.6 |
| 2,970,242 | 1/1961 | Jepsen et al. | 315/3.6 X |
| 3,027,453 | 3/1962 | Carter et al. | 315/3.6 X |
| 3,290,545 | 12/1966 | Mourier | 315/3.6 |
| 3,519,956 | 7/1970 | Hai et al. | 333/1.1 |
| 3,710,063 | 1/1973 | Aime | 333/111 |
| 3,868,602 | 2/1975 | Meddaugh | 333/1.1 |
| 4,107,575 | 8/1978 | Vanderplaats et al. | 315/3.6 |
| 4,147,956 | 4/1979 | Horigome et al. | 315/3.6 |

*Primary Examiner*—Saxfield Chatmon, Jr.

*Attorney, Agent, or Firm*—Stanley Z. Cole; Gerald M. Fisher

[57] ABSTRACT

Oscillations due to backward waves in a high-power traveling-wave tube (TWT) are inhibited by a non-reciprocal attenuating device which essentially absorbs only backward waves. A directional coupler mediates the exchange of energy between the TWT interaction circuit and an external circuit containing a non-reciprocal loss element such as a ferrite isolator. In such embodiments the high-frequency power handled by the isolator is much less than the power in the TWT interaction circuit. The frequency band handled by the isolator is much narrower than that handled by the TWT. Coupling to the loss element is through one or more resonant circuit elements such that a "notch" of attenuation is obtained for a backward wave only, at a certain frequency where oscillations are prone, such as the frequency associated with $2\pi$ phase shift per cavity in a coalesced-mode coupled-cavity TWT.

15 Claims, 10 Drawing Figures

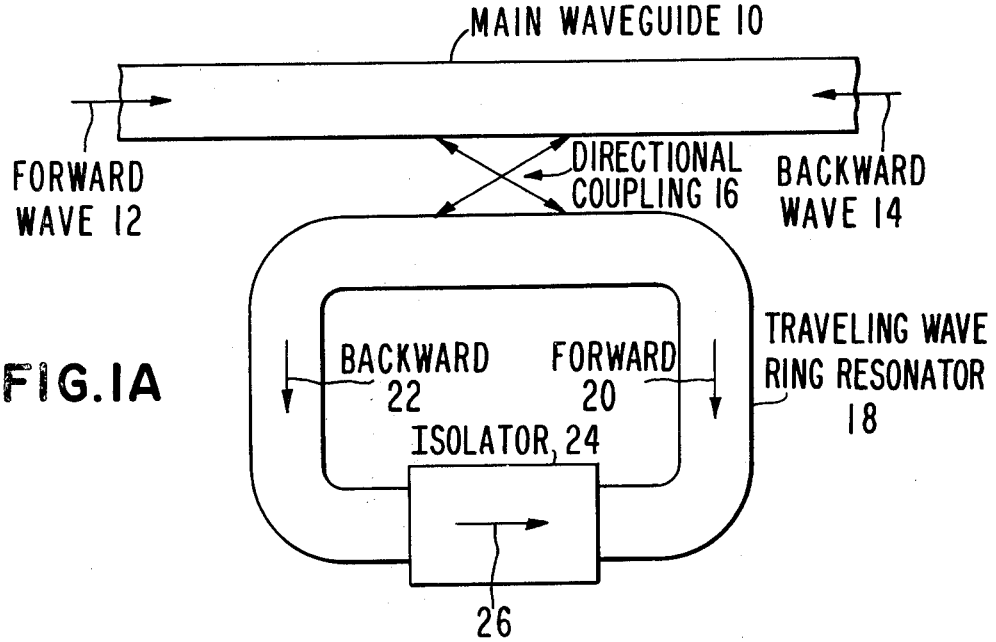
FIG.1A
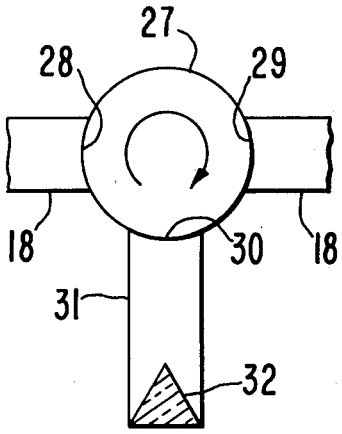
FIG.1B
FIG.3A
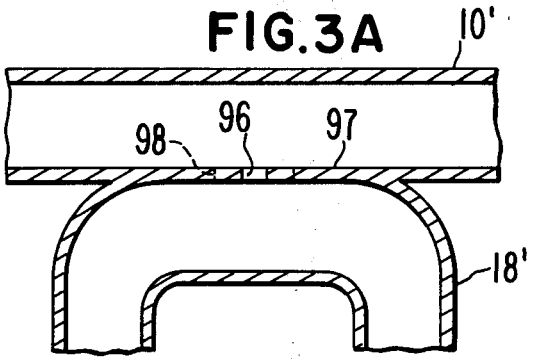
FIG.3B
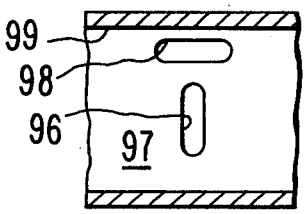

TRAVELING WAVE TUBE WITH NON-RECIPROCAL ATTENUATING ADJUNCT

FIELD OF THE INVENTION

The invention pertains to traveling-wave tubes, particularly wide-band and very high power tubes in which oscillations due to backward waves on the circuit are a major problem.

PRIOR ART

A major problem in traveling-wave tubes has always been oscillations caused by waves on the slow-wave interaction circuit flowing in a direction opposite to that of the signal being amplified. In the common forward-wave amplifier the backward waves flow opposite to the direction of motion of the electron beam. These waves do not generally interact strongly with the electron beam, but are likely to be re-reflected by a circuit mismatch at the input end of the tube giving rise to forward waves which are amplified by the electron beam interaction to produce regenerative gain and eventual oscillations. The backward waves may be initially caused by reflections from a mismatched output circuit or by perturbations in the interaction circuit itself, particularly periodic perturbations. In some circumstances, which are of major concern in the present invention, space harmonics of backward waves are synchronous with the beam and are amplified directly, with consequent oscillations.

In low-power TWTs, oscillations are typically controlled by applying extended attenuation to a length of the interaction circuit. In high-power TWTs, attenuation alone has proven inadequate. The next step is to sever the circuit into relatively short sections with no circuit-wave connection between them. Each section is terminated in a resistive load, so the wave power must be restarted in each new section. Both of these attenuating schemes absorb valuable energy and in the case of very high power tubes dissipating this energy is often a problem.

Several attempts have been made to use the non-reciprocal wave transmission properties of ferrimagnetic resonant materials to attenuate the unwanted backward waves while transmitting the useful forward waves. U.S. Pat. No. 2,970,242 issued Jan. 31, 1961 to R. L. Jepsen describes a folded waveguide interaction structure having a series of ferrite non-reciprocal attenuators placed directly in the waveguide. This scheme has the disadvantage that the entire signal power must flow through the ferrite. Even though this is in the direction of good transmission, the material is somewhat lossy and much of the power is lost. Moreover, the outgassing, cooling and biasing of the ferrite inserts present many technical problems.

U.S. Pat. No. 3,144,616 issued Aug. 11, 1964 to R. L. Jepsen describes non-reciprocal attenuators in a circuit directly connecting adjacent ends of the severed parts of the interaction circuit. The forward circuit power flows through the isolator to the next severed circuit portion, while the backward power is absorbed. This would avoid throwing away all of the circuit power at a sever. This scheme has not been made to work successfully because the phase shift of the wave through the isolator must be kept equal to the phase shift of the space charge wave on the beam. This has not proved to be practical over a wide range of frequencies. U.S. Pat. No. 4,118,671 issued Oct. 3, 1978 to D. J. Connolly describes a very similar approach, which equally suffers the inability to yield correct phasing over the full bandwidth of a truly wide-band TWT.

SUMMARY OF THE INVENTION

An object of the invention is to improve the stability of a traveling-wave tube by attenuating backward-wave power without comparable attenuation of the desired forward-wave signal power.

A further object of the invention is to selectively attenuate backward-wave power at a certain frequency where oscillations are prone.

A further object is to attenuate backward-wave power in a non-reciprocal loss element which handles only a small fraction of the interaction circuit power.

A further object is to provide attenuation of backward-wave power in a coalesced-mode wide-band coupled-cavity TWT at a frequency close to that corresponding to $2\pi$ phase shift per cavity.

These objects are attained by introducing coupling between the interaction circuit and external circuit elements via one or more directional couplers. In the interconnection with the non-reciprocal loss element, directional distinctions are preserved. Thus, the backward waves can be attenuated much more than the forward waves.

Certain potential oscillation frequencies are selectively dealt with because resonant circuit elements interconnect the non-reciprocal loss element and the directional coupler.

BRIEF DESCRIPTION OF THE DRAWINGS

FIG. 1A is a schematic diagram of a directional notch filter for waveguide traveling waves.

FIG. 1B is a schematic diagram of an alternative non-reciprocal element for the filter.

FIG. 3A is a section of a directional coupler useful in the invention.

FIG. 3B is a sectional view of the coupler of FIG. 3A.

DESCRIPTION OF THE PREFERRED EMBODIMENTS

Figure 2:
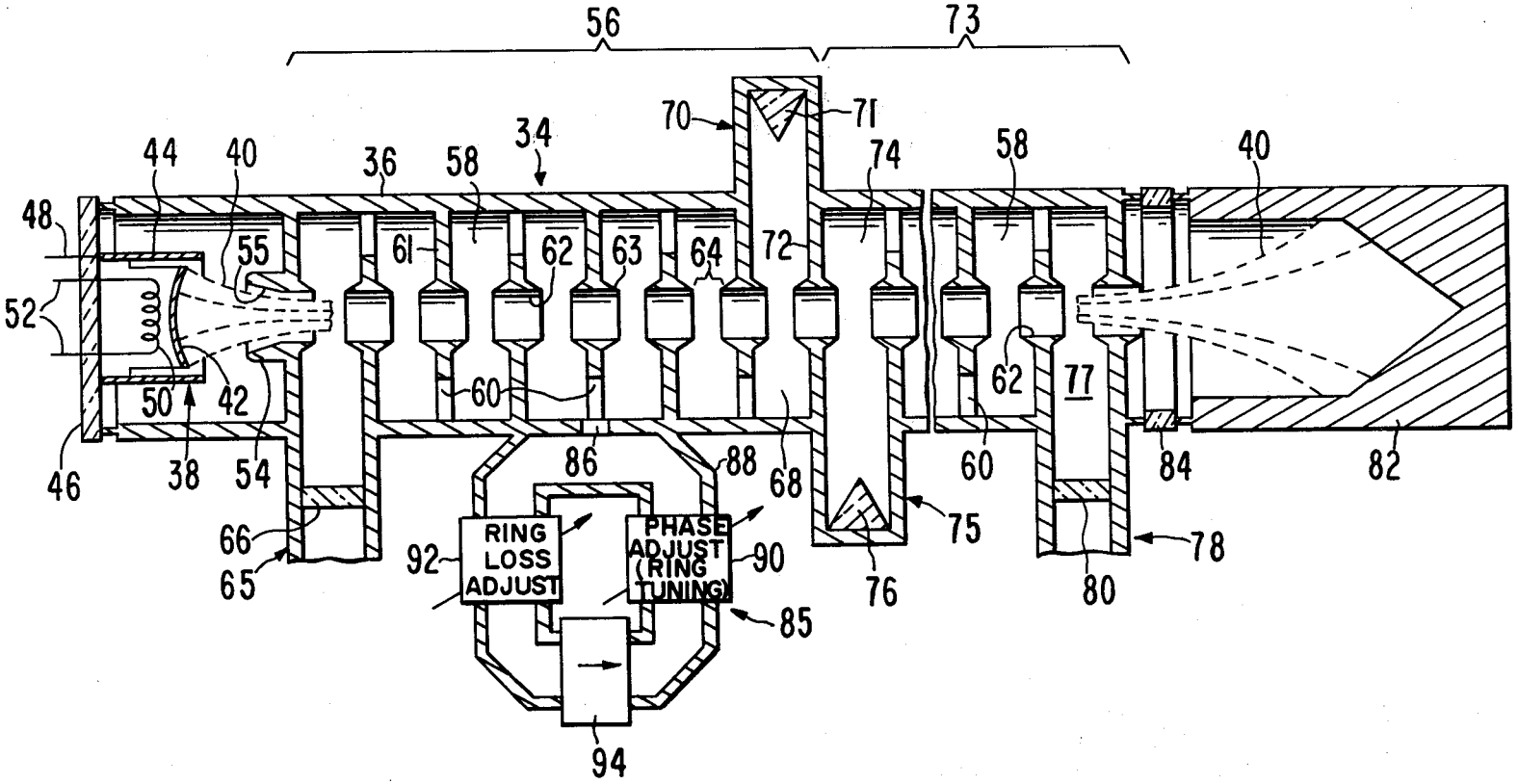
FIG. 2 is a schematic diagram of a traveling-wave tube embodying the invention.

In FIG. 1A is shown a simplified schematic diagram of a non-reciprocal notch filter as used in the invention. The purpose of the filter is to selectively attenuate waves flowing in a main waveguide 10. In particular, "backward" wave 14 flowing from right to left is attenuated much more than "forward" wave 12 flowing from left to right. To accomplish this a directional coupler 16, indicated in the conventional functional circuit element representation, is used to couple waves from main waveguide 10 into a closed ring-shaped waveguide 18 functioning as a traveling-wave ring resonator. Forward wave 12 couples into ring resonator 18 as forward wave 20 traveling in a clockwise direction. Backward wave 14 couples into backward wave 22 traveling counterclockwise. Inserted in series in ring resonator 18 is an isolator 24 which transmits counterclockwise wave 22 with only a small attenuation. Isolator 24 absorbs clockwise wave 20 almost completely. Isolator 24 may be of conventional construction, that is an element of ferrimagnetic, electrically non-conducting ceramic biased with a transverse static magnetic field (not shown) to resonate near the frequencies of interest. In a preferred mode of operation the coupling coefficient of directional coupler 16 may be quite small, so that only a small fraction of any incident-wave power in main waveguide 10 is transferred into the waveguide from which ring resonator 18 is formed. The small fraction of the power of forward wave 12 coupled into ring 18 is immediately absorbed in isolator 24 and lost. However, this loss may be so small as to be unimportant. The portion of the power of backward wave 14 coupled into resonator 18 as backward wave 22, on the other hand, is attenuated only very slightly by isolator 24 and so continues to recirculate counterclockwise in resonator 18. At a frequency for which the length of ring resonator 18 is an exact whole number of wavelengths, the backward wave power coupled into it from main backward wave 14 is cumulative, and the amplitude of backward wave 22 will build up to a large value. This effectively provides a tighter coupling between backward waves 14 and 22. If the coupling coefficient of coupler 16 is properly related to the total loss in ring resonator 18 including isolator 24, the entire backward wave 14 in main guide 10 will be absorbed by said total ring loss. The frequency bandwidth of the absorption increases with the loss in resonator 18 and decreases with its length. By choosing the proper constants one can thus design the attenuator to cover a desired narrow band of frequencies. Isolator 24 needs to handle, in direction 20, only a small fraction of the forward power guide 10, so it can be of simple construction. When the amplitude of backward wave 14 becomes zero, the power through the isolator 24 in the "easy" direction 26 should be zero. However, a very small amount of such power, at worst, might flow if directional coupler 16 is not perfectly directive.

FIG. 1B illustrates an alternative non-reciprocal element which may be used in place of isolator 24. This uses a circulator 27 having two sequential ports 28 and 29 connected in series with ring 18. A third port 30 is connected to a load waveguide 31 containing a dissipative load 32. Power is transferred between ports as shown by the arrow. The circulator element is capable of handling more wrong-way power than the isolator of FIG. 1A because the dissipation is removed from the ferrite element.

FIG. 2 is a schematic section view of a coupled-cavity traveling-wave tube 34 embodying the invention. Tube 34 comprises a metallic vacuum envelope 36, as of copper. An electron gun 38 projects a converging beam of electrons 40 as a cylindrical, pencil beam through the length of envelope 36. Electron beam 40 is emitted from a concave thermionic cathode surface 42. Surrounding cathode 42 is a cylindrical focus electrode 44 which shapes the electric fields to converge beam 40. Cathode 42 and focus electrode 44 are mounted on an insulating vaccum seal 46. A cathode connecting lead 48 is brought out through vacuum seal 46 for applying potential, typically negative with respect to ground, to cathode 42 and focus electrode 44. Cathode 42 is heated to thermionic emitting temperatures by a radiant heater 50 energized by current introduced through leads 52, also hermetically sealed through vacuum seal 46.

A hollow anode 54 projecting toward cathode 42 is operated at a positive potential (ground) with respect to cathode 42 to accelerate beam 40. Beam 40 is converged through a central aperture 55 in anode 54. It is held focused into a cylindrical beam by an axial magnetic field, not shown. Inside envelope 36 is disposed a slow-wave interaction circuit 56 comprising a series of hollow cavities 58, as for example cylindrical pill-boxes with axes directed along beam 40, coupled sequentially by irises 60 in the metal walls 61 separating cavities 58. Walls 61 contain central appertures 62 to permit passage of electron beam 40. Walls 61 have projecting lips 63 to reduce the length of the gaps 64 in which the electrons interact with the axial electric fields of cavities 58. This reduction is necessary because circuit 56 as shown has a fundamental mode of propagation as a backward wave referred to the forward motion of beam 40, and it is thus necessary to cause interaction with the forward-wave space harmonic of the fields in circuit 56. A shortened gap 64 permits strong interaction with the space harmonic. An input signal wave is introduced to the first of cavities 58 through an input waveguide 65 containing a dielectric vacuum window 66. The signal wave interacts with electron beam 40 throughout the length of slow wave circuit 56, being amplified by the interaction. At the last cavity 68 the circuit wave is coupled into sever waveguide 70 and absorbed in a wedge of lossy material 71. There is no aperture 60 in the final wall 72 of the last cavity 72 of circuit 56, so that no circuit wave enters the output slow-wave circuit 73. By this time, electron beam 40 has acquired density modulation which carries the signal into circuit 73 where it is further amplified. The first cavity 74 of circuit 73 is coupled by a waveguide 75 to a terminating load 76 to absorb any backward-wave power which might otherwise be reflected and amplified to cause oscillations. The last cavity 77 of circuit 73 is coupled through waveguide 78 to the useful load, not shown. A dielectric window 80 across waveguide 78 seals the vacuum. After exiting cavity 77, electron beam 40 is permitted to expand by terminating the magnetic focussing field and is collected on the inner surface of collector 82. The energy dissipated is removed by cooling means, not shown, such as water or air cooling fins. Collector 82 is mounted on envelope 36 via dielectric insulator 84 so that the collected current can be monitored and the potential of collector 82 may be less positive than that of envelope 36 to increase the efficiency of the TWT.

A non-reciprocal attenuating device 85, coupled to slow wave circuit 56 is analogous to the directional notch filter of FIG. 1A. A directional coupler port 86 through envelope 36 is coupled into an iris 60 between adjacent cavities 58. In this symmetrical position between cavities the circuit wave on circuit 56 is essentially a traveling wave so that the directional coupler separates the forward and backward waves. Coupler 86 drives a waveguide ring 88 which is resonant at frequencies for which its electrical length is an integral number of wavelengths. These frequencies can be set by the ring tuner 90 which is a variable phase shifter. A variable attenuator 92 in ring 88 adjusts the loss in the ring so that it can be set for critical coupling to the backward wave in circuit 56, if such a wave were to exist at the frequency selected by tuner 90. An isolator 94 performs the function of isolator 24 in FIG. 1A. That is, clockwise traveling waves which are only coupled to a very small degree from the forward wave in circuit 56, are absorbed without completing a full traverse of ring 88. However, potential counterclockwise traveling waves coupled from potential backward waves at the selected frequency in circuit 56 are allowed to build up in a resonant fashion so that critical coupling is reached with circuit 56. If a backward wave were to travel along circuit 56 it thus would be completely transferred to the ring at the resonant frequency. At other frequencies, there would be no such transfer; the wave would remain within circuit 56.

FIGS. 3A and 3B are two sectional views of a known type of directional coupler suitable for use with the invention. FIG. 3A is a horizontal section through the two intercoupled waveguides 10' and 18' as illustrated in FIG. 1. FIG. 3B is a vertical section showing the details of the directional coupler ports. A first transverse slot 96 at the center of the common waveguide broad wall 97 couples the transverse component of magnetic field of the electromagnetic wave, that is the field at the center of the broad side 97 of the waveguide. A second elongated slot 98 in the broad wall 97 extends longitudinally near the narrow wall 99. It couples the longitudinal component of the magnetic field near the narrow walls. As the magnetic field pattern of the wave progresses down the guide these two components reach maximum value at the position of slots 96 and 98 at times differing by one-quarter cycle. The phase relationship of these maximum magnetic fields depends on the direction of propagation of the wave and thus the wave in the coupled waveguide 18' will have a direction depending on the direction of propagation of the driving wave in primary guide 10'. This type of coupler is peculiarly advantageous for coupling from the slow wave circuit of a cavity-type traveling wave tube because the coupling is all at a single transverse plane. Directional couplers using apertures spaced in the direction of propagation are not suitable because in the TWT the circuit wave is growing rapidly as it traverses the slow-wave circuit and the energy coupling would not be the same for two identical, spaced apertures.

Figure 4:
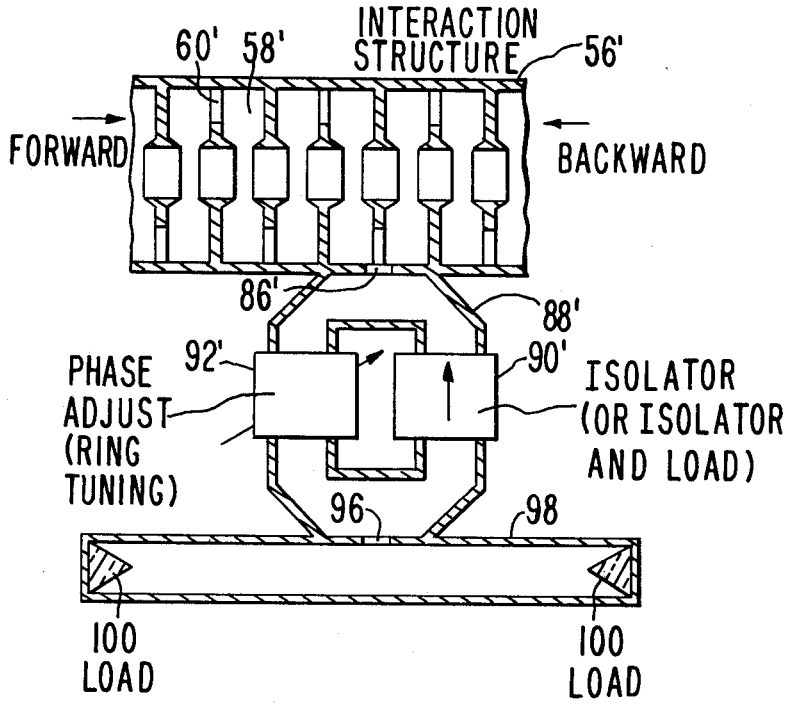
FIG. 4 is a schematic diagram of a modification of the attenuator of FIG. 2.

FIG. 4 shows an embodiment alternative to the structure of FIG. 2. Resonant ring 88' does not contain an interior attenuator such as 92 in FIG. 2. Instead, a coupling aperture 96 (which may be directional or non-directional) couples ring 18' to a load waveguide 98 which is terminated in dissipative loads 100. The power handling ability is increased because the loads may be large and are easy to cool.

Figure 5:
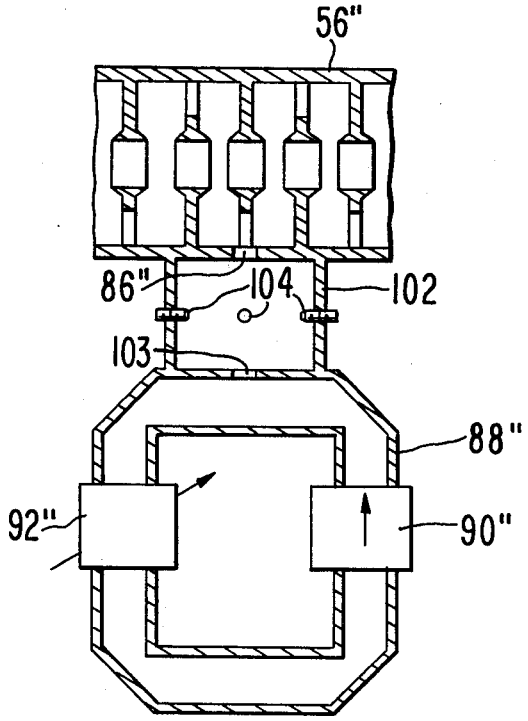
FIG. 5 is a schematic diagram of an alternative attenuator embodying the invention.

FIG. 5 illustrates another embodiment of the directional notch attenuator. Here directional coupler 86'' feeds a resonant cavity 102 which in turn feeds the directional resonant ring 88'' containing isolator 90'' and adjustable loss element 92''. Ring 88'' may also contain an adjustable phase-shifter, not shown. Cavity 102 is configured to resonate at the very same frequency being dealt with in two orthogonal modes. These are transverse-electric modes, relative to the vertical axis of cavity 102, for each of which cavity 102 is tuned to resonance by an opposing pair of tuning screws 104 in the walls on which the electric field terminates. Directional coupler 86'' causes a traveling wave in circuit 56'' to excite two standing waves in cavity 102, one in each of the two orthogonal modes but 90° out of phase. In other words a circularly polarized resonant mode is set up in cavity 102, the direction of rotation being dependent on the direction of the wave in slow-wave circuit 56''. Thus the directional selectivity is retained. A second directional coupler 103 couples the rotating standing waves from cavity 102 into traveling waves in waveguide ring 88''. By a process exactly analogous to the input coupling to cavity 102 the waves in ring 88'' travel in a direction determined by the direction of rotation of the wave in cavity 102. The net result is that the waves in ring 88'' have the same directional relation to the waves in circuit 56'' that occurs in the attenuator appendage of FIG. 2. One advantage of adding intermediary cavity 102 is that it can be used as a transformer of the overall coupling coefficient between the two waveguides. This is done by having different coupling coefficients for directional couplers 86'' and 103. The transformer allows a wider selection of the bandwidths of the absorption notch. It also causes the absorption of forward waves to be more truly neglibible at frequencies outside the bandwidth of cavity 102. Moreover, it increases the physical distance of isolator 90'' from the TWT body, minimizing interference between beam-focussing and ferrite-biasing magnets. The cavity 102 can also conveniently contain a ceramic insert serving as a vacuum barrier; the isolator and other elements of ring 88'' could then most conveniently operate outside of the vacuum.

Figure 6:
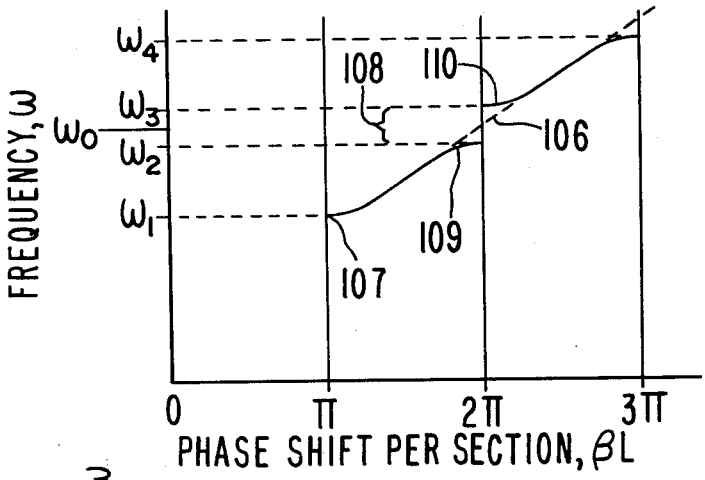
FIG. 6 is a sketch of the dispersion diagram of the slow-wave circuit of FIG. 2.
Figure 7:
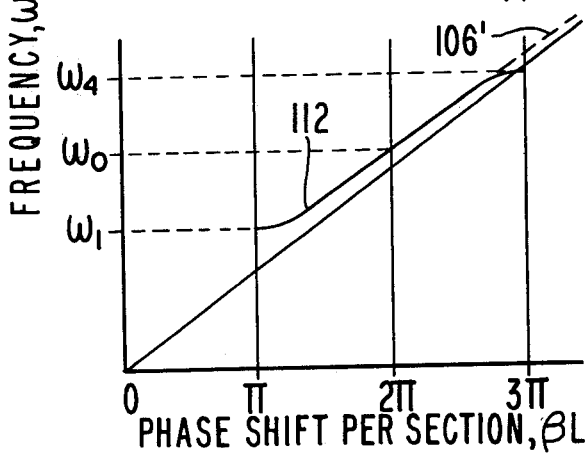
FIG. 7 is a modification of FIG. 6 in which the modes have been coalesced.

FIGS. 6 and 7 illustrate a problem in very wide-band high-power TWTs which the invention is peculiarly adapted to eliminate. FIG. 6 is a dispersion diagram for the folded waveguide type of coupled-cavity circuit shown in FIG. 2. The phase shift per section is plotted horizontally against the frequency omega plotted vertically. Line 106 illustrates the dispersion that would be obtained with a smooth folded waveguide having no reflective discontinuities. The phase shift per section is measured with respect to the path of the electron beam. At the low frequency cutoff $\omega_1$ there is no phase shift in a smooth waveguide, but due to the folding the field seen by the beam reverses at each gap so the low frequency cutoff point 107 corresponds to $\pi$ radians phase shift per section. However, in real life there are discontinuities and local reflections in the so-called folded waveguide. For example the drift-tube lips 63 and the coupling irises 60 in FIG. 2 represent periodic discontinuities, as well as the very imperfect U-bends. A stop-band of frequencies 108 is produced centered at a frequency $\omega_0$ corresponding to $2\pi$ phase shift per section of the unperturbed smooth waveguide represented by 106. The propagation dispersion curve is thus broken into two discontinuous sections 109 and 110 representing two distinct modes of propagation. Conventional TWTs operate only in the lower, so-called "cavity" mode 109. Limited success has been attained in operating over a wider frequency range by the so-called "coalesced mode" principle. This mode is described in U.S. Pat. No. 3,684,913 issued Aug. 15, 1972 to B. G. James, W. A. Harman, and J. A. Ruetz. The principle is described therein as adjusting the self-resonant frequency of the coupling irises to the resonant frequency which the cavities would have if no coupling irises were present—assuming, for the moment, that the coupling irises are all on the same side of the electron beam rather than staggered from side to side. An equivalent explanation, for the case where the coupling irises are indeed staggered from side to side as in FIG. 2, is to adjust the additional susceptance introduced by iris 67 to produce a reflection cancelling the reflection from the susceptance introduced by drift tube lips 63 and beam apertures 62. When this is done perfectly the stop band 108 is eliminated and the dispersion characteristic becomes as illustrated in FIG. 7, that is essentially a single mode of transmission from cutoff frequency $\omega_1$ to a higher band edge $\omega_4$ corresponding to $3\pi$ phase shift per section.

The success of coalesced-mode folded-waveguide TWTs is limited by an instability due to the electron beam being synchronous with a forward space harmonic of a potential backward wave at a frequency close to the frequency $\omega_0$ corresponding to $2\pi$ phase shift. The present invention can be used to provide directional attenuation of backward waves at this critical frequency without disturbing appreciably the useful forward waves. Only a small amount of energy is extracted from the forward wave because the effective Q-factor of the resonant attenuator is then so low that the coupling to this wave is very far below critical. It has also been found that the phase disturbance of the forward wave is also negligible. The potential backward wave, on the other hand, is critically coupled, at least at a single frequency, due to the potential resonant build up of this wave in the attenuator and hence is effectively terminated at the location of the attenuator at the frequency of interest.

The wide bandwidth of the TWT, $\omega_1$ to $\omega_4$, is in no way limited by the bandwidth of the isolator. It is an objective of the present invention to allow a narrow-band low-power isolator to serve as a control on a wide-band high-power TWT. In this invention, the "passing" direction 26, for the isolator 24 in FIG. 1A, is associated with the "blocking" direction 14 in the TWT waveguide 10, and vice versa. This peculiar circumstance is responsible for some of the advantages of the present invention.

Figure 8:
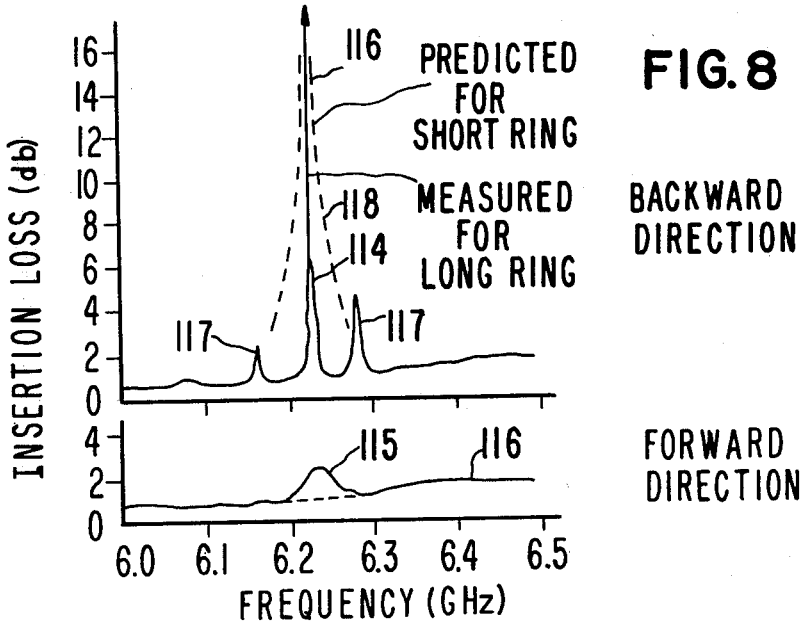
FIG. 8 is a plot of non-reciprocal attenuation in an embodiment of the invention.

FIG. 8 shows the results of measurements made for the attenuator and slow-wave circuit of FIG. 5. Insertion loss on the slow-wave circuit is plotted against frequency. For the backward direction the loss 116 was greater than 20 dB at the resonant frequency, 6.23 GHz, as shown by the solid curve in the upper graph. Loss in the forward direction 115 as plotted in the lower graph was about 1.5 dB above the non-frequency-sensitive loss 114 of the slow-wave circuit itself. The exceedingly narrow bandwidth of the backward loss was due to the use of a very long experimental ring resonator having high Q and high dispersion. The secondary absorption peaks 117 were caused by adjacent modes of this long resonator having one more or less electrical wavelength than for the operating mode. Calculations were made for an equivalent ring resonator designed as short as feasible. In this case the bandwidth would be determined by the loaded Q of the intermediate cavity 102. The results of these calculations are plotted as curve 118 and indicate that useful directional attenuation can be obtained over a frequency band of a sizeable fraction of one percent. Within this band, the TWT appears to a backward wave alone to have a circuit sever at the location of the coupler 86″. Backward-wave oscillations in this band are prevented from starting up because the TWT appears to such waves to be broken up into shorter sections.

The above examples have been given to illustrate and teach the invention. It will be obvious to those skilled in the art that many other embodiments can be made within the scope of the invention. For example, there are very many types of slow-wave structures used in TWTs. The folded-waveguide structure was described because it is fairly common and because its analogy to a true folded waveguide makes the operation of the invention more easily understandable. Other types of coupled-cavity slow-wave circuits might be used. Also, directional couplers for helix-type slow-wave circuits are known in the art and these could be used as elements with either a coaxial or hollow waveguide directional attenuator. The scope of the invention is intended to be limited only by the following claims and their legal equivalents.

I claim:

1. In a traveling-wave tube, non-reciprocal attenuator means comprising:

a traveling-wave ring resonator capable of supporting a first and a second wave having opposite directions, non-reciprocal loss means directively coupled to said traveling-wave ring resonator such that said first wave is attenuated more than said second wave, a directional coupler coupling a wave traveling in one direction on the slow-wave interaction circuit of said tube preferentially to said first wave and coupling a wave traveling on said interaction circuit opposite to said one direction preferentially to said second wave.

2. The tube of claim 1 wherein said non-reciprocal loss means is an isolator forming a series element of said ring resonator.

3. The tube of claim 1 wherein said non-reciprocal loss means is a circulator having two ports connected in series with said ring resonator and a third port connected to a dissipative load.

4. The tube of claim 1 further comprising directional filter means for coupling said directional coupler to said loss resonator.

5. The tube of claim 4 wherein said directional filter means comprises a cavity having two quadrature-phased orthogonal modes resonant at substantially the same frequency.

6. The tube of claim 1 wherein said one direction is the direction of the electron flow in said traveling-wave tube.

7. The tube of claim 1 wherein said traveling-wave ring resonator comprises in part a resonant cavity having two orthogonal modes resonant at substantially the same frequency.

8. The tube of claim 8 wherein said first and second waves are circularly polarized, substantially standing waves with opposite rotations.

9. The tube of claim 1 wherein said non-reciprocal loss means is a ferrimagnetically resonant element in said traveling-wave ring resonator, adapted for ferrimagnetic resonance at a frequency near the resonant frequency of said resonator.

10. In a coupled-cavity traveling-wave tube, a non-reciprocal attenuator means affecting only a predetermined narrow range of frequency out of the operating bandwidth of said tube comprising:

a traveling-wave loop resonator capable of supporting a first and a second wave propagating in opposite directions, non-reciprocal loss means directly coupled to said loop resonator such that said first wave is attenuated more than said second wave, a directional coupler coupling a wave traveling in one direction on the slow-wave interaction circuit of said tube preferentially to said first wave and coupling a wave traveling on said interaction circuit opposite to said one direction preferentially to said second wave.

11. The tube of claim 10 wherein said directional coupler comprises a coupler port through the outer wall of said tube, said coupler port being coupled symmetrically into an iris between adjacent cavities of said tube.

12. In combination with a traveling-wave tube having a slow wave interaction circuit supporting both a backward and forward wave:

a directional coupler coupled to said interaction circuit, loss resonator means external to said interaction circuit but coupled thereto by said directional coupler, said loss resonator means supporting a first and a second wave having opposite directions, said directional coupler coupling said forward wave preferentially to said first wave and coupling said backward wave preferentially to said second wave, said resonator means preferentially attenuating said first wave and recirculating said second wave therewithin to increase the amplitude of said second wave relative to said first wave.

13. The combination of claim 12 wherein said loss resonator means includes non-reciprocal loss means for attenuating said first wave preferentially to said second wave.

14. The combination of claim 12 wherein said loss resonator is a traveling-wave loop resonator.

15. The combination of claim 12 wherein said loop resonator includes a variable phase shifter functioning as a tuner for said resonator.

* * * * *